US005421560A

United States Patent [19]

Forte et al.

[11] Patent Number: 5,421,560

[45] Date of Patent: * Jun. 6, 1995

[54] SLAG CONTROL APPARATUS FOR MOLTEN METAL VESSELS

[75] Inventors: Gary L. Forte, Northville; James P. McGuire, Taylor; Wayne Miller, Gibraltar; David B. Vinson, Redford, all of Mich.

[73] Assignee: AJF, Inc., Plymouth, Mich.

[ * ] Notice: The portion of the term of this patent subsequent to Oct. 5, 2010 has been disclaimed.

[21] Appl. No.: 280,055

[22] Filed: Jul. 25, 1994

Related U.S. Application Data

[63] Continuation-in-part of Ser. No. 196,309, Feb. 15, 1994.

[51] Int. Cl.[6] ..... B22D 41/14

[52] U.S. Cl. ..... 266/91; 266/230; 266/272

[58] Field of Search ..... 266/230, 91, 227, 236, 266/238, 272; 222/602, 597; 164/337, 437

[56] References Cited

U.S. PATENT DOCUMENTS

| | | | |
|---|---|---|---|
| 11,676 | 9/1854 | Morris | 73/323 |
| 1,815,361 | 7/1931 | Morris et al. | 266/91 |
| 2,295,932 | 9/1942 | Campbell et al. | 137/172 |
| 3,459,209 | 8/1969 | Kobusch et al. | 222/597 |
| 4,431,169 | 2/1984 | Fuzii et al. | 266/236 |
| 4,468,013 | 8/1984 | LaBate | 266/227 |
| 4,526,349 | 7/1985 | Schwer | 266/45 |
| 4,553,743 | 11/1985 | LaBate, II et al. | 266/272 |
| 4,610,436 | 9/1986 | LaBate, II et al. | 266/272 |
| 4,637,592 | 1/1987 | LaBate, II et al. | 266/272 |
| 4,640,498 | 2/1987 | LaBate et al. | 266/272 |
| 4,922,994 | 5/1990 | Ogura et al. | 266/230 |
| 4,968,007 | 11/1990 | Forte et al. | 266/100 |
| 5,249,780 | 10/1993 | Forte et al. | 266/230 |
| 5,303,902 | 4/1994 | Forte et al. | 266/230 |

FOREIGN PATENT DOCUMENTS

| | | |
|---|---|---|
| 57-171568 | 10/1982 | Japan . |
| 62-230667 | 9/1987 | Japan . |
| 0175142 | 8/1989 | Japan . |
| 0517542 | 2/1972 | Switzerland . |

*Primary Examiner*—Scott Kastler
*Attorney, Agent, or Firm*—Basile and Hanlon

[57] ABSTRACT

A slag control shape is releasably mounted on a cover for a molten metal vessel. An actuator is connected to a slag control shape release member to move the release member from a first position engaged with the slag control shape to a second position disengaged from the slag control shape to allow the slag control shape to descend into the molten metal vessel. Upon the occurrence of a predetermined condition, such as a predetermined weight of molten metal in the vessel or a predetermined total time of molten metal discharge from the vessel, a controller generates a signal to the actuator to automatically release the slag control shape into the vessel. The controller is located remote from the actuator and transmits the activation signal to the actuator by radio frequency signals, directly through an electrical conductor, or to a light emitter which transmits a light beam to a photodetector mounted on the cover.

22 Claims, 6 Drawing Sheets

SLAG CONTROL APPARATUS FOR MOLTEN METAL VESSELS

CROSS REFERENCE TO CO-PENDING APPLICATION

The present invention is a continuation-in-part application of co-pending U.S. patent application Ser. No. 08/196,309 filed on Feb. 15, 1994 in the names of Gary L. Forte, James P. McGuire and Wayne Miller and entitled "SLAG CONTROL SHAPE RELEASE APPARATUS FOR MOLTEN METAL VESSELS."

BACKGROUND OF THE INVENTION

1. Field of the Invention

The present invention relates, in general, to metal making apparatus and, specifically, to molten metal receptacles and, more specifically, to slag control shapes used in molten metal vessels.

2. Description of the Art

In metal making processes, such as steel making, molten metal is transferred from a furnace or converter by a ladle to a tundish or directly to a casting machine. In all metal making processes, and, in particular, in steel making processes, a layer of slag containing metal impurities forms above the top surface of the molten metal within the ladle and the tundish. When the molten metal is discharged from the ladle or tundish, it is necessary to maintain a separation between the slag and the molten metal so that high quality steel without significant amounts of slag can be produced.

The slag forms a layer of impurities several inches thick on top of the layer of molten metal in the ladle and in the tundish. In addition, the flow of molten metal through the discharge nozzle in the ladle or tundish creates a vortex which introduces a conically-shaped rotation to the molten metal immediately above the discharge nozzle. When a sufficient quantity of molten metal is maintained within the ladle or tundish, the vortex forms completely within the molten metal layer and does not reach to the slag layer atop the molten metal layer. However, when the level of molten metal within the ladle or tundish drops below the predetermined critical depth, the vortex reaches into the slag layer and draws slag through the center of the vortex to the discharge nozzle along with molten metal. This causes the introduction of slag into the molten metal as it is discharged from the ladle or the tundish and results in steel having less than desirable quantities as well as creating a potentially hazardous situation.

In order to prevent the introduction of slag into the molten metal, various slag control shapes, such as balls, frusto-conical bodies, etc., as shown in U.S. Pat. Nos. 4,725,045 and 4,968,007, are introduced into the transfer ladle or tundish. Such slag control shapes or bodies have a predetermined specific gravity less than the specific gravity of the molten metal and greater than the specific gravity of the slag layer so that the slag control shape or body is buoyantly supported at the interface between the slag layer and the molten metal layer. Such slag control bodies or shapes are also designed to locate and center themselves automatically in the vortex formed above the discharge nozzle from the molten metal vessel or receptacle. The lower portion of such slag control bodies is disposed in the molten metal layer and will enter and seat within the upper portion of the discharge nozzle of the molten metal receptacle when the molten metal layer drops below a predetermined depth so as to block the discharge nozzle and prevent the discharge of slag from the receptacle.

While such slag control bodies or shapes have found widespread use and effectively block the undesirable discharge of slag from a molten metal vessel, such as a transfer ladle or tundish, the introduction of such slag control bodies into the molten metal receptacle has proved to be a problem.

Typically, such slag control bodies are introduced into the transfer ladle or tundish at a predetermined time during the discharge of molten metal from the ladle or tundish. The time of insertion of the slag control body is based on an operator's experience, typically on the total time of molten metal discharge, or on a potentially inaccurate vessel or ladle weight reading from a load cell in a ladle weight system. As ladles positioned in caster turret arms are typically 20 feet or more in height, overhead cranes have been used to drop the slag control body into the ladle at the point in time indicated by an operator. However, such cranes are assigned numerous other tasks which make it difficult to insure that a crane is available at the precise time that the operator determines it necessary to insert the slag control body into the molten metal vessel.

A small number of metal making or casting machine installations have a stairway located adjacent the discharge position of a ladle which enables a worker, such as a ladleman, to climb to the top of the ladle and insert the slag control body into the ladle at the required time. However, the height of the ladle, the approximate 25 pounds or more weight of the slag control body, and the high temperatures involved in the molten metal process make such a task difficult, undesirable and dangerous. Further, the ladleman typically has other duties in monitoring the metal making process which must be neglected for the time it takes to climb the stairs and insert the slag control body. Dedicating one person solely to the task of inserting the slag control body into the molten metal vessel at the required time adds costs to the metal making process as such an individual is only required is to perform his single task at widely spaced, intermittent intervals.

Further, when such slag control shapes are dropped into a molten metal vessel, they typically fall from 10 to 15 feet before hitting the slag layer. Due to the buoyancy characteristics of a slag control shape and its momentum during dropping into the vessel, the slag control shape will initially pass through the slag layer and into the molten metal and then bob up out of the molten metal and slag until it settles at the molten metal/slag interface. However, this bobbing force and the inherent buoyancy characteristics of a slag control shape frequently cause the slag control shape to settle at a position away from a desired position directed above the discharge outlet of the molten metal vessel. Indeed, it is infrequent for the slag control shape to settle directly over the discharge outlet since the discharge outlet is typically $2\frac{1}{2}$ to $4\frac{1}{2}$ inches in diameter as compared to the 10 to 20 foot diameter of a typical ladle. Thus, when a vortex begins to form above the discharge outlet when the molten metal reaches a low level within the ladle or vessel, the slag control shape may not be able to reach the vortex in time to serve its function of blocking the outlet to prevent the discharge of slag through the outlet. Furthermore, even if the slag control shape initially settles directly over the discharge outlet, it frequently drifts away since a vortex may not have formed above the outlet and never returns to the desired centered position thereby defeating its intended purpose.

In order to address these problems, the Applicants' previously devised a slag control shape release apparatus which is disclosed in U.S. Pat. No. 5,249,780 issued on Oct. 5, 1993. In this apparatus, the hanger of a slag control shape extends through a bore in a molten metal vessel cover and, also, through a bore in a lid pivotally mounted on the cover. A pin is mounted on the lid and biased to a position extending through the hanger to support the slag control shape on the cover. An actuating cable is connected to the pin and extends from the cover to an easily accessible position for remote actuation of the release mechanism to release the pin from the slag control shape and to allow the descent of the slag control shape into the molten metal vessel.

A similar release apparatus has also been devised by the Applicants and is disclosed in U.S. Pat. No. 5,303,902 issued on Apr. 19, 1994. In this apparatus, a mounting means including a reciprocally movable pin is mounted on a frame pivotally mounted on the cover of a molten metal vessel and is actuated by a cable extending from the pin to a free end remote from the cover. A cable wound around a reel mounted on the frame is attached to the slag control shape to control the descent of the slag control shape into the molten metal vessel after release from the pin.

Yet another release apparatus has been devised by the Applicants' and is disclosed in co-pending U.S. patent application Ser. No. 08/196,309, filed on Feb. 15, 1994. In this latter release apparatus, a lid is removably implacable in a bore in the cover. The hanger or rod of a slag control shape extends through the lid and is releasably received in mounting means on the lid. The actuating means is similar to that in the other release devices devised by the Applicants' in that it is in the form of a cable having an end operable from a location remote from the cover on the molten metal receptacle. In this latter design, means are provided for releasably connecting the actuating means to the mounting means after the mounting means and the lid have been mounted on the cover. This enables the heavy mounting and activating means to be mounted on the lid rather than on the cover which is typically formed of lightweight refractory or ceramic fiber materials.

While all of these apparatus have proved effective at accurately dropping a slag control shape into a molten metal vessel and permitting the timely release of the slag control shape from an easily accessible location remote from the cover on top of a molten metal vessel, such release apparatus still require the manual intervention of the ladleman or operator at the proper time to pull the cable to release the slag control shape from the cover. Such manual intervention still requires the operator's experience to determine the proper time to release the slag control shape, which is usually based on the total time of metal flow from the receptacle or on a scale weight reading to provide an indication of the amount of molten metal remaining in the receptacle.

Thus, it would be desirable to provide a control apparatus for automatically inserting a slag control shape into a molten metal vessel at a predetermined time during a molten metal forming operation. It would also be desirable to provide a control apparatus for automatically inserting a slag control shape which can be mounted on the lightweight cover currently used with a molten metal vessel.

SUMMARY OF THE INVENTION

The present invention is a slag control shape release apparatus for a molten metal receptacle having an open top end, side and bottom walls, an interior cavity containing a layer of slag covering a layer of molten metal, a discharge nozzle formed in the bottom wall, a cover removably closing the open top end of the receptacle and having an aperture extending therethrough, and a slag control shape insertable into the receptacle and buoyantly supported at the interface between the layer of slag and the layer of molten metal, the slag control shape release apparatus includes means, mounted on the cover, for releasably mounting the slag control shape on the cover and means, connected to the mounting means, for actuating the mounting means to release the slag control shape from the cover into the molten metal receptacle, the actuating means being operable from a location remote from the cover when the cover is mounted on the molten metal receptacle.

In one embodiment, a bore is formed in and extends through the cover. The release apparatus includes a lid removably implacable in and closing the bore in the cover. An aperture extends through the lid for receiving the hanger or rod of a slag control shape therethrough. Means are mounted on the lid for releasably mounting the slag control shape on the lid. An actuating means is fixedly mounted on the cover and is releasably connected to the mounting means for actuating the mounting means to release the slag control shape from the mounting means and to allow the descent of the slag control shape into the molten metal receptacle. The actuating means is operable from a location remote from the cover mounted on the molten metal receptacle. Finally, means are provided for releasably connecting the actuating means to the mounting means after the mounting means and the lid have been mounted on the cover.

Preferably, the mounting means comprises a frame fixedly mounted on the lid and slidably supporting a tubular pin. The pin has a first end extendible through the frame for supporting the hanger of a slag control shape extending through the aperture in the lid. A biasing means is mounted on the frame and engages the pin to normally bias the pin to a first position in which the first end of the pin extends over and past the aperture in the lid for supporting the hanger of a slag control shape thereon. Stop means are also mounted on the rod and engagable with the frame for limiting the axial movement of the rod to the first position.

In another embodiment, the cover of the molten metal vessel is provided with a through bore which communicates with the interior chamber of the molten metal receptacle or vessel. The release apparatus in this embodiment includes a base having an aperture therein. A pin is provided with first and second ends. Means are mounted on the base for slidably mounting the pin for axial sliding movement with respect to the aperture in the base. An actuating means is connected to the second end of the pin. The opposite end of the actuating means is located at a remote, easily accessible position for retracting the pin from the first position to separate the pin from the hanger of the slag control shape to allow the descent of the slag control shape into the molten metal vessel.

In this embodiment, the mounting means comprises a frame formed of a plurality of spaced plates mounted on the base. A biasing means is mounted between two of the plates for normally biasing a first end of the pin to a first position beyond the aperture in the base to support the hanger of the slag control shape on the pin. Means for limiting the axial advance of the pin toward the first position are also mounted on the pin and cooperate with at least one of the plates in the base. A guide member is mounted on and extends from the base and concentrically surrounds the aperture in the base. The guide member is slidably mountable into the bore in the cover for releasably mounting the release apparatus on the cover of a molten metal vessel.

Both of these two embodiments provide for remote release of a slag control shape from the cover into a molten metal vessel. However, the apparatus employed to releasably mount the slag control shape on the cover is light in weight to permit the mounting apparatus to be mounted on molten metal vessel covers formed of lightweight refractory or ceramic fiber materials. At the same time, the mounting apparatus permits easy mounting of the slag control shape therein.

The slag control shape release apparatus of the present invention overcomes certain problems associated with the use of such slag control shapes in molten metal receptacles, such as ladles or tundishes. The release apparatus of the present invention enables the slag control shape to be dropped at the proper time, as determined by a ladleman, into the interior of the molten metal receptacle wherein the slag control shape is buoyantly supported at the slag/molten metal interface directly above the discharge nozzle to prevent the discharge of slag from the molten metal receptacle when the layer of molten metal reaches a critical, low level within the molten metal receptacle. The same operator or ladleman attending to the molten metal process utilizing the molten metal receptacle can thusly control the release of the slag control shape at the proper time without leaving his normal work station or neglecting his other duties.

The slag control shape release apparatus of the present invention also eliminates the need for overhead cranes to drop slag control shapes into molten metal receptacles as well as the use of an individual specifically assigned the task of inserting the slag control shape into the molten metal receptacle at the proper time.

The slag control shape release apparatus of the present invention is of simple and inexpensive construction arid can be easily mounted on existing molten metal receptacle covers without extensive modification of such covers or molten metal receptacles.

The slag control shape of the present invention also ensures that the slag control shape remains centered directly above the discharge outlet of a molten metal vessel. This enables the slag control shape to consistently and repeatedly perform its intended purpose of blocking the discharge outlet when the molten metal/-slag interface reaches a predetermined low level to prevent the discharge of slag through the outlet in the vessel.

In another embodiment, a slag control apparatus automatically releases the slag control shape from the cover upon the occurrence of a predetermined condition during the metal forming operation. The slag control apparatus includes means, mounted on the cover, for releasably mounting a slag control shape on the cover. Means are also mounted on the cover and connected to the mounting means for moving the mounting means to a position releasing the slag control shape from the mounting means. Finally, means are provided which are responsive to the occurrence of the predetermined condition for automatically activating the moving means to release the slag control shape into the molten metal vessel.

The predetermined condition is preferably a predetermined weight of molten metal remaining in the molten metal vessel. A weight signal is provided by a conventional ladle weight system employing a load cell which detects the weight of the ladle or vessel, the cover and the molten metal and slag within the vessel on the ladle support arms. The output signal from the weight system may be a signal provided at a predetermined, adjustably selected, total weight which is typically selected to correspond to a low level of molten metal within the vessel, such as 10,000 to 25,000 pounds of molten metal depending upon the size of the vessel or ladle. Alternately, the output signal from the weight system may simply be a signal proportional to the total measured weight, with a comparison performed by a controller with an adjustably settable threshold value which is set to correspond to the desired level of molten metal within the vessel at which time it is desired to drop the slag control shape into the vessel. When a predetermined weight of molten metal is detected, the activating means automatically moves the moving means to a position releasing the slag control shape from the mounting means for descent into the vessel.

In a preferred embodiment, the activating means comprises a source of pressurized fluid, and a fluid operated cylinder having an extensible and retractable piston rod fixedly connected to the moving means. A valve means supplies pressurized fluid from the fluid source to the cylinder in response to a control signal generated by a control means in response to the occurrence of the predetermined condition, such as the predetermined weight of molten metal remaining in the vessel as indicated by a signal from the ladle weight system.

The moving means preferably comprises a frame having a pin slidably mounted in the frame and movable between first and second positions. The pin, when in the first position, releasably supports a slag control shape thereon.

A lid is removably implacable in and closes a bore in the cover. A through bore extends through the lid for slidably receiving a slag control shape therethrough. The moving means is fixedly mounted on the lid.

Means are provided for releasably connecting the piston rod to the pin to permit the moving means to be disengaged from the piston rod and removed along with the lid from the cover to permit the mounting of a new slag control shape in the mounting means.

Means are provided for communicating the control signal from the control means to the valve means. In one embodiment, the communicating means comprises a radio frequency transmitter responsive to the control signal from the control means for transmitting a radio frequency signal to a receiver means mounted on the cover and connected to the valve means. The receiver means, upon receiving the transmitted signal from the transmitter means, activates the valve means to supply pressurized fluid to the cylinder to move the piston in the cylinder in a direction to release the slag control shape from the pin in the mounting means.

In another embodiment, the communicating means comprises a light emitter spaced from a photodetector mounted on the cover of the molten metal vessel. The light emitter is connected by an electrical conductor to the control means and, when activated by the control signal from the control means, generates a light beam which is projected toward the photodetector. The photodetector, upon detecting the light beam from the light emitter, generates an activating signal to the activating means which moves the mounting means to a position releasing the slag control shape for descent into the vessel.

In yet another embodiment, the control signal to the activating means may be transmitted directly from the control means via an electrical conductor to the activating means.

The slag control apparatus of the present invention uniquely provides for automatic insertion of a slag control shape into a molten metal vessel upon the occurrence of a predetermined condition during a metal forming operation in order to prevent the flow of slag through the discharge outlet of the vessel. This automatic insertion of the slag control shape eliminates the need for an operator to closely monitor the metal forming operation to determine the proper time to release the slag control shape from the mounting apparatus disposed on the cover of the vessel.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

The present invention is a control apparatus which automatically inserts a slag control shape into a molten metal vessel, such as a transfer ladle or tundish, at an appropriate time as well as providing an indication to the operator or ladleman of the proper time to close the outlet flow gate on the vessel.

Figure 5:
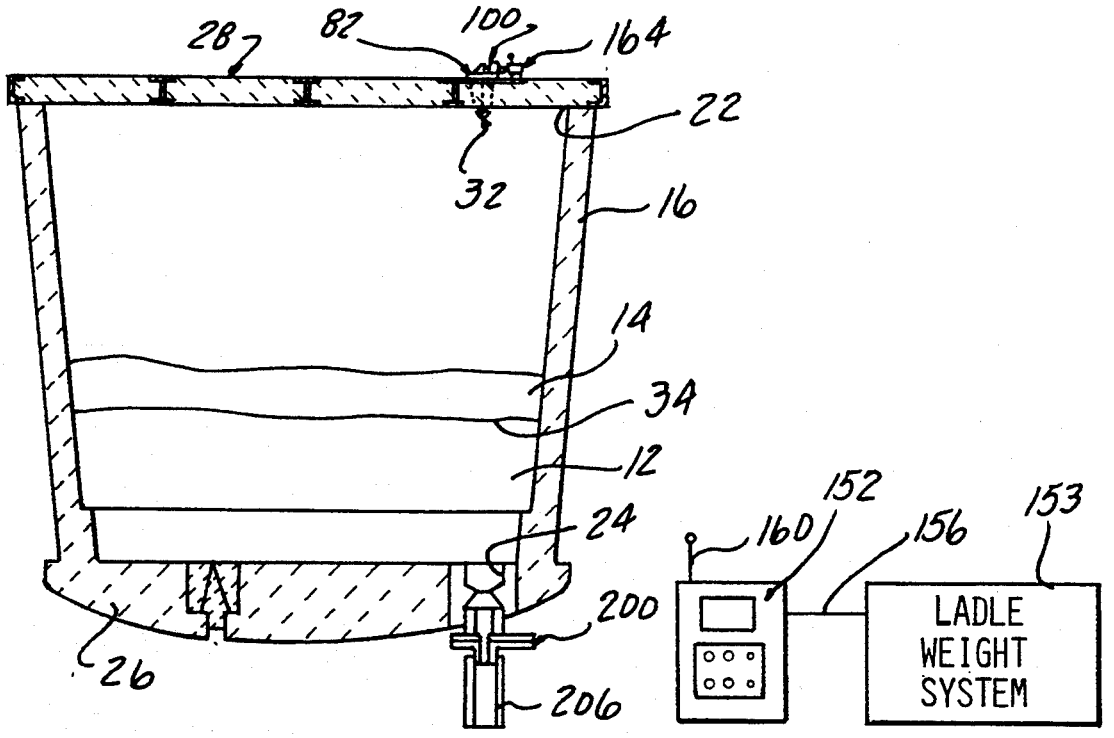
FIG. 5 is a partially cross sectioned, side elevational view of a slag control apparatus constructed in accordance with another embodiment of the present invention.

As shown in FIG. 5, a molten metal receptacle 10 is provided for containing a layer of molten metal 12, such as steel, etc. As is conventional, a layer of slag 14 forms on the top of the layer of molten metal 12 within the vessel 10. Although the molten metal vessel 10 is illustrated as being in the form of a transfer ladle used to transfer molten metal from a tapping converter or furnace to a tundish or casting machine, it will be understood that the slag control release apparatus of the present invention may also be employed with other types of molten metal vessels, such as tundishes, etc.

By way of background, the molten metal vessel or ladle 10 includes outer, generally conical side walls 16 typically formed of a metallic outer shell and an inner layer formed of a refractory material, such as firebrick, etc. An open top end 22 is formed on the ladle 10. A discharge nozzle or outlet 24 is formed in a bottom wall 26 of the ladle 10 and provides an outlet path for molten metal from the ladle 10 to a tundish, casting machine, etc.

A cover 28 having a generally circular shape is formed of a refractory material and is removably inserted over the open top end 22 of the ladle 10 to close off the interior of the ladle 10 in order to retain heat within the molten metal 12 in the ladle 10. The cover 28 is mounted on and removed from the ladle 10 by means of a crane which engages a hook 30 mounted on the cover 10.

As is conventional, a slag control shape or body denoted generally by reference number 32 in FIGS. 1–3 and 5, is employed to prevent the discharge of slag 14 through the discharge nozzle 24 when the layer 12 of molten metal reaches a predetermined low depth. The slag control shape or body 32 may have any predetermined size and shape, such as that disclosed in Applicant's own U.S. Pat. No. 4,968,007 or the plug shown in U.S. Pat. No. 4,725,045. The contents of U.S. Pat. No. 4,968,007, with regard to the description and use of the slag control body, are incorporated herein by reference. Generally, however, such slag control shapes or bodies 32 are formed of a suitable refractory material having a specific gravity less than the specific gravity of the molten metal 12, but higher than the specific gravity of the slag 14. In this manner, the slag control shape or body 32 buoyantly floats at the interface 34 formed between the layer of molten metal 12 and the slag layer 14. When the layer of molten metal 12 reaches a predetermined low level, the lower portion of slag control body 32 will first prevent the vortex action from occurring and as draining is completed, will engage the discharge nozzle 24 in the ladle 10 and thereby block the further discharge of molten metal and, more importantly, the discharge of slag 14 from the ladle 10.

Figure 1:
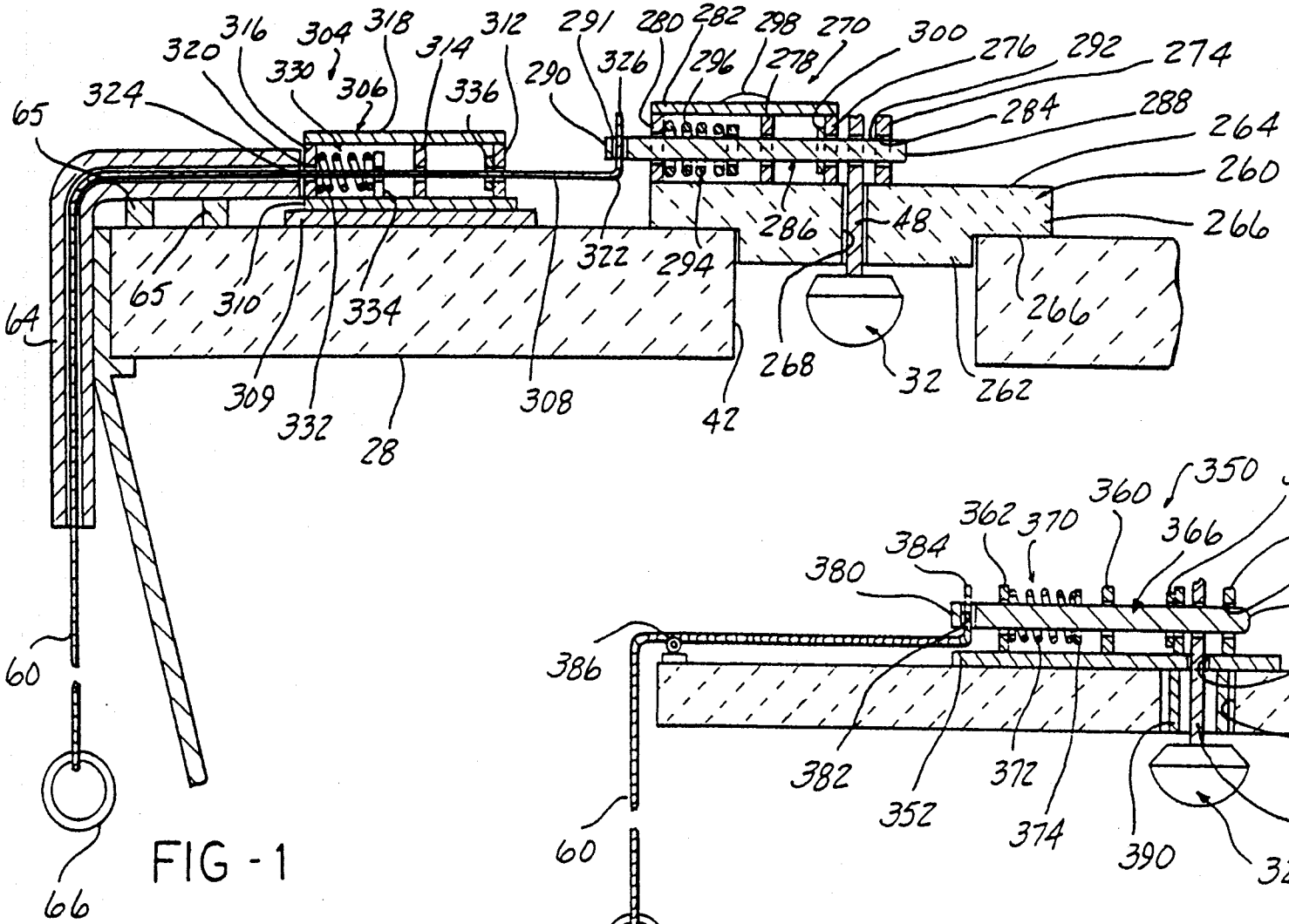
FIG. 1 is a partially cross sectioned, side elevational view of one embodiment of a slag control shape release apparatus according to the present invention.

In one embodiment shown in FIG. 1, an aperture or bore 42 in the cover 28 is located directly over the discharge outlet 24 of the well or tap hole, in the molten metal vessel 10 when the cover 28 is mounted on the open top end 22 of the molten metal vessel 10.

In this embodiment, the slag control shape release apparatus includes a lid 260 which is sized to be removably implacable in and to close the bore 42 in the cover 28. The lid 260 may be formed of any suitable material, however, preferably, a refractory material is used to form the lid 260 so as to retain heat within the molten metal vessel. A steel frame may also be employed with the refractory material to form the lid 260. By way of example only, the lid 260 includes a lower, generally circular bottom portion 262 which slidably fits within the bore 42 in the cover 28. An enlarged top end 264 is formed on the lid 260 and forms an annular flange 266 which fits over the top edge of the cover 28 surrounding the bore 42 in the cover 28 to removably support the lid 260 on the cover 28 with the bottom portion 262 of the lid 260 disposed within the bore 42 in the cover 28. A bore 268 extends through the lid 260 for receiving the hanger 48 therein.

A mounting means denoted generally by reference number 270 is mounted on the lid 260 for releasably mounting a slag control shape 32 on the lid 260. The mounting means 270 preferably includes a frame formed of a plurality of spaced plates which are individually fixedly mounted on the top end 264 of the lid 260 by welding or by other means. Optionally, a base plate, not shown, attached to the lid 260 may be with each of the plates affixed to the base plate. Preferably, the frame includes a first plate 274 which is mounted on the top end 264 of the lid 260 adjacent to and on one side of the bore 268 in the lid 260. Immediately adjacent to an opposite side of the bore 268 and aligned with the first plate 274 is a second plate 276. A third and a fourth plate 278 and 280, respectively, are also mounted on the top end 264 of the lid 260 and are aligned with and spaced from each other and from the second plate 276. A top plate 282 is fixedly mounted to the second, third and fourth plates 276, 278 and 280 by welding or by means of suitable fasteners to rigidly hold the second, third and fourth plates 276, 278 and 280 in place.

Each of the plates 274, 276, 278 and 280 has an internal aligned bore denoted by reference number 284. An elongated, tubular rod or pin 286 is slidably disposed through the aligned bores 284. The pin 286 has a first end 288 and an opposed second end 290. The first end 288 of the pin 286 is positioned to slidably extend through the bore 284 in the first plate 274 when the pin 286 is biased to a first, normal position shown in FIG. 15. In this first position, the pin 286 releasably supports the hanger 48 of a slag control shape 32 on a first end portion 292 adjacent to the first end 288. In the first position of the pin 286, the first end portion 292 is disposed between the first plate 274 and the second plate 276 and over the bore 268 in the lid 260.

A biasing means 294 is mounted about the pin 286 and disposed between the third and fourth plates 278 and 280, respectively, for biasing the pin 286 to the first position. The biasing means 294 preferably comprises a coil spring 296 which seats at one end on the fourth plate 280 and, at another end, against a washer or stop 298 fixedly mounted on the pin 286. A limit or stop means 300 is also fixedly mounted on the pin 286 for limiting the axial advance of the pin 286 to the first position. The limit or stop means 300 preferably comprises a washer 300 fixedly mounted on the pin 286 and disposed between the second and third plates 276 and 278, respectively. When the biasing means 294 urges the pin 286 to the first position, the washer 300 will engage the second plate 276 to limit the sliding advance of the pin 286 so as to position the pin 286 in the normal, first position shown in FIG. 15 in which the first end portion 292 releasably supports the hanger 48 of a slag control shape 32.

An actuating means denoted generally by reference number 304 is mounted on the cover 28 adjacent to the bore 42 in the cover 28. The actuating means 304 includes a frame structure 306 fixedly mounted on the cover 28. The frame structure 306 slidably supports a plunger 308 therein.

By way of example only, the frame structure 306 includes a base plate 309 which is fixedly mounted on the cover 28. A mounting plate 310 is attached to the base plate 309 and is joined to first, second and third vertically extending plates 312, 314 and 316, respectively, by welding or by suitable fasteners. A top plate 318 is mounted to the outer ends of the first, second and third plates 312, 314 and 316 to form a rigid frame structure. Aligned bores 320 are formed in each of the first, second and third plates 312, 314 and 316 and slidably receive the plunger 308 therethrough.

The plunger 308 is formed with a first end 322 and an opposed second end 324. The first end 322 and the second end 290 of the pin 286 on the mounting 270 are provided with a connecting means for releasably connecting the first end 322 of the plunger 308 to the second end 290 of the pin 286 when the mounting means 270 and the lid 260 are mounted on the cover 28 of the molten metal receptacle. By way of example only, the connecting means comprises an annular ring formed on the second end 290 of the pin 286, a central aperture 291 formed in the ring. A perpendicular leg 326 is formed on the first end 322 of the plunger 308 and is releasably insertable through the aperture 291 in the ring portion of the second end 290 of the pin 286 to releasably attach the plunger 308 to the pin 286.

A biasing means 330 is mounted in the frame structure 306 of the actuating means 304. Preferably, the biasing means 330 includes a coil spring 332 which seats between a washer 334 fixedly mounted on the plunger 308 and the third plate 316 for biasing the plunger 308 to a normal, first position shown in FIG. 15 in which the plunger 308 is positioned to releasably engage the second end 290 of the pin 286. A limit or stop means 336 is also mounted on the plunger 308 and is disposed between the first and second plates 312 and 314, respectively. The limit or stop means 336 is preferably in the form of a washer which engages the first plate 312 to limit the axial advance of the plunger 308 to the first position under the force of the biasing spring 332.

The second end 324 of the plunger 308 is fixedly connected to a flexible cable denoted generally by reference number 60 and described in detail in the previous embodiments of the present invention. The cable 60 extends through a cable sleeve 64 which is supported by means of blocks 65 on the cover 28. One end of the cable 60 terminates in a ring 60 located at an easily accessible position, such as near the bottom of the ladle or molten metal vessel 10 on which the cover 28 is mounted to enable an operator, such as a ladleman, to grasp the ring 66 and exert a downward force on the cable 68. This downward force causes a sliding movement of the plunger 308 and a simultaneous sliding movement of the pin 286 to the left in the orientation shown in FIG. 15 to move the pin 286 to the second position clear of the bore 268 in the lid 260. During the sliding movement toward the second position, the first end 288 of the pin 286 slides from the first plate 274 on the lid 260 and from the hanger 48 on the slag control shape 32 to release the slag control shape 32 from the lid 260 and to enable the slag control shape 32 to drop into the molten metal vessel. Release of the cable 60 causes the biasing spring 332 to urge the plunger 308 back toward the first position. At the same time, the biasing spring 296 also urges the pin 286 back to the first position shown in FIG. 15.

In operation, when it is necessary to mount a new slag control shape 32 on the pin 286, the lid 260 is removed from the cover 28 and brought to an easily accessible position, such as on the plant floor adjacent to the molten metal vessel or ladle 10. The pin 286 is then manually urged to the second position to bring the first end 288 of the pin 286 in close proximity with the second plate 276. The hanger 48 of a slag control shape 32 is inserted through the bore 268 in the lid 260 and the pin 286 released such that the first end 288 of the pin 286 slides through the hanger 48 and the aperture 284 in the first plate 274 to support the hanger 48 of the slag control shape 32 on the first end portion 292 of the pin 286.

The lid 260 is then remounted in the bore 42 in the cover 28 with the annular ring 290 on the second end of the pin 286 inserted over the perpendicular leg 326 on the first end 322 of the plunger 308 to connect the mounting means 270 to the actuating means 304. The apparatus is then in an operative condition for release of the slag control shape 32 at the proper time.

It should also be noted that a flexible cable and reel may be mounted on the mounting means 270, with the cable attached to the hanger 48 of the slag control shape 32, in the same manner as described in U.S. Pat. No. 5,303,902, to control the descent of the slag control shape into the molten metal vessel 10 after the hanger 48 of the slag control shape 32 has been released from the pin 286 by the actuating means 304.

Figure 2:
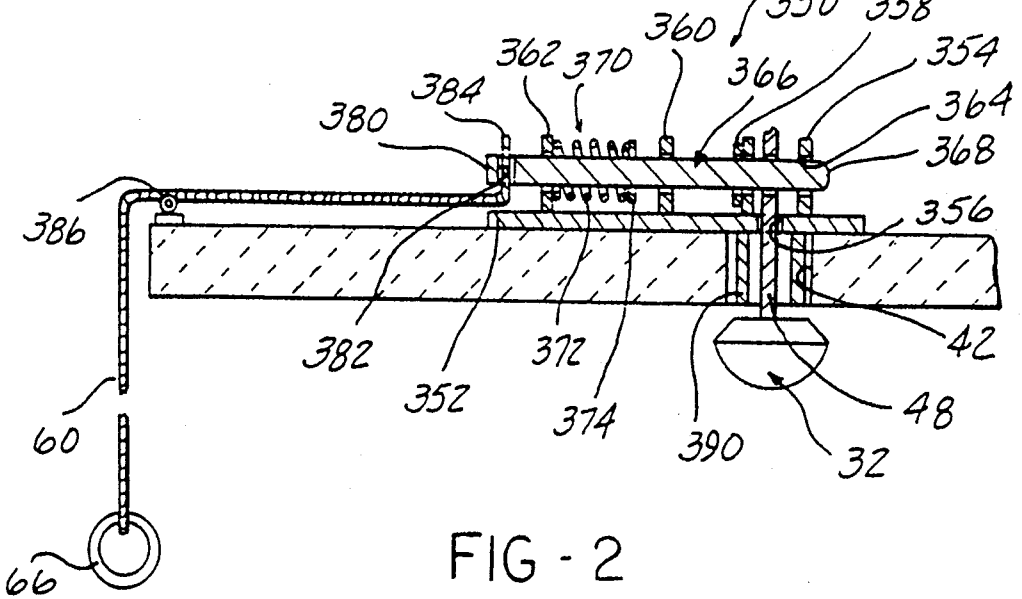
FIG. 2 is a partially cross sectioned, side elevational view of another embodiment of a slag control shape release apparatus according to the present invention.

Another embodiment of a slag control shape release apparatus according to the present invention is shown in FIG. 2. In this embodiment, the release apparatus is denoted generally by reference number 350 and is in the form of a self contained unit which is removably implacable in the bore 42 of the cover 28 on the top end of a molten metal receptacle 10.

The release apparatus 350 includes an elongated base 352 formed of a metallic material, such as steel. A plurality of spaced, generally vertically extending plates are fixedly mounted on the base 352 and extend outward from one surface of the base 352. The plurality of plates include a first plate 354 mounted on the base 352 immediately adjacent one side of an aperture 356 formed in the base 352. Second, third and fourth plates 358, 360 and 362, respectively, are also mounted on the base 352 and are spaced from each other, with the second plate 358 spaced from the first plate 354 and positioned adjacent to an opposite side of the aperture 356 in the base 352. A top, not shown, but similar to top 318 in FIG. 1 may be fixedly joined to the second, third and fourth plates 358, 360 and 362, respectively, to rigidly join the plates together. Aligned bores, each denoted by reference number 364, are formed in each of the first, second, third and fourth plates 354, 358, 360 and 362 and slidably receive an elongated, tubular pin 366 therethrough.

The pin 366 has a first end 368 which slidably extends through the aperture 364 in the first plate 354 when the pin 366 is in a first, normal position shown in FIG. 2 in which a first end portion 370 of the pin 368 extends over the aperture 356 in the base 352 for releasably supporting the hanger 48 of the slag control shape 32 thereon. A biasing means 370 is mounted between the third and fourth plates 360 and 362 and is coupled to the pin 366 for normally urging the pin 366 to the first position shown in FIG. 2. Preferably, the biasing means 370 comprises a coil spring 372 which surrounds the pin 366 and seats between the fourth plate 362 and a washer 374 fixedly mounted on the pin 366. A limit or stop means preferably in the form of a washer 376 fixedly mounted on the pin 366 is disposed between the second and third plates 358 and 360 and engages the second plate 358 to limit the axial advance of the pin 366 to the first position shown in FIG. 2. It should be noted that the washer 374 can also act as the limit or stop in place of the washer 376.

A second end 380 of the pin 366 is provided with a releasible connecting means which cooperates with a mating part of the releasible connecting means mounted on one end of a flexible cable 60. Similar to the embodiment shown in FIG. 1, the connecting means preferably comprises an annular ring 382 formed on the second end 380 of the pin 366 which releasably engages a perpendicular leg 384 attached to one end of the flexible cable 60. The flexible cable 60 may be mounted in a cable sleeve, similar to cable sleeve 64 shown in FIG. 1 or it may be freely disposed over the cover 28 and through a pulley 386 mounted on an outer edge of the cover 28. The free end of the cable 60 extends to a remote, easily accessible position with respect to the molten metal vessel on which the cover 28 is mounted to provide for sliding actuation of the pin 366 to a second position, in the same manner as described above in the embodiment shown in FIG. 1. Release of the opposite end of the cable 60 enables the biasing means 370 to urge the pin 366 back to the first, normal position shown in FIG. 2.

A guide means 390 is mounted on the base 352 and extends outward from a surface of the base 352 opposite from the surface on which the plates 354, 358, 360 and 362 are mounted. The guide means 390 may be in the form of a pair of spaced plates which are spaced apart a distance substantially equal to the diameter of the bore 42 in the cover 28. Preferably, however, the guide means 390 comprises a hollow, tubular member made of steel, stainless steel, ceramic and the like and having a diameter slightly less than the diameter of the bore 42 in the cover 28.

In use, the pin 366 is manually retracted to the second position. The hanger 48 of a slag control shape 32 is then inserted from the lower side of the cover 28 through the guide means 390 and the aperture 356 in the base 352 and raised into position by means of a rod or cable with a hook at one end, for example, until the opening in the hanger 48 is aligned with the pin 366. The pin 366 is then released to enable the biasing means 370 to slide the pin 366 to the first position with the first end 368 of the pin 366 sliding through the hanger 48 and the bore 364 in the first plate 354 and the first end portion 370 moved to a position supporting the hanger 48.

Although the following description specifically describes an improvement to the slag control shape release apparatus disclosed by the Applicants' in co-pending application Ser. No. 08/196,309, as well as a new control apparatus for automatically releasing a slag control shape and/or providing an indication of the time to close the outlet flow gate, it will be understood that the improvements to the Applicants' prior slag control shape release apparatus as well as the new control apparatus described hereafter may also be employed, with minor modifications, on Applicants' slag control shape release apparatus disclosed in U.S. Pat. Nos. 5,249,780 and 5,303,902, the contents of which are incorporated herein in their entirety.

Figure 3:
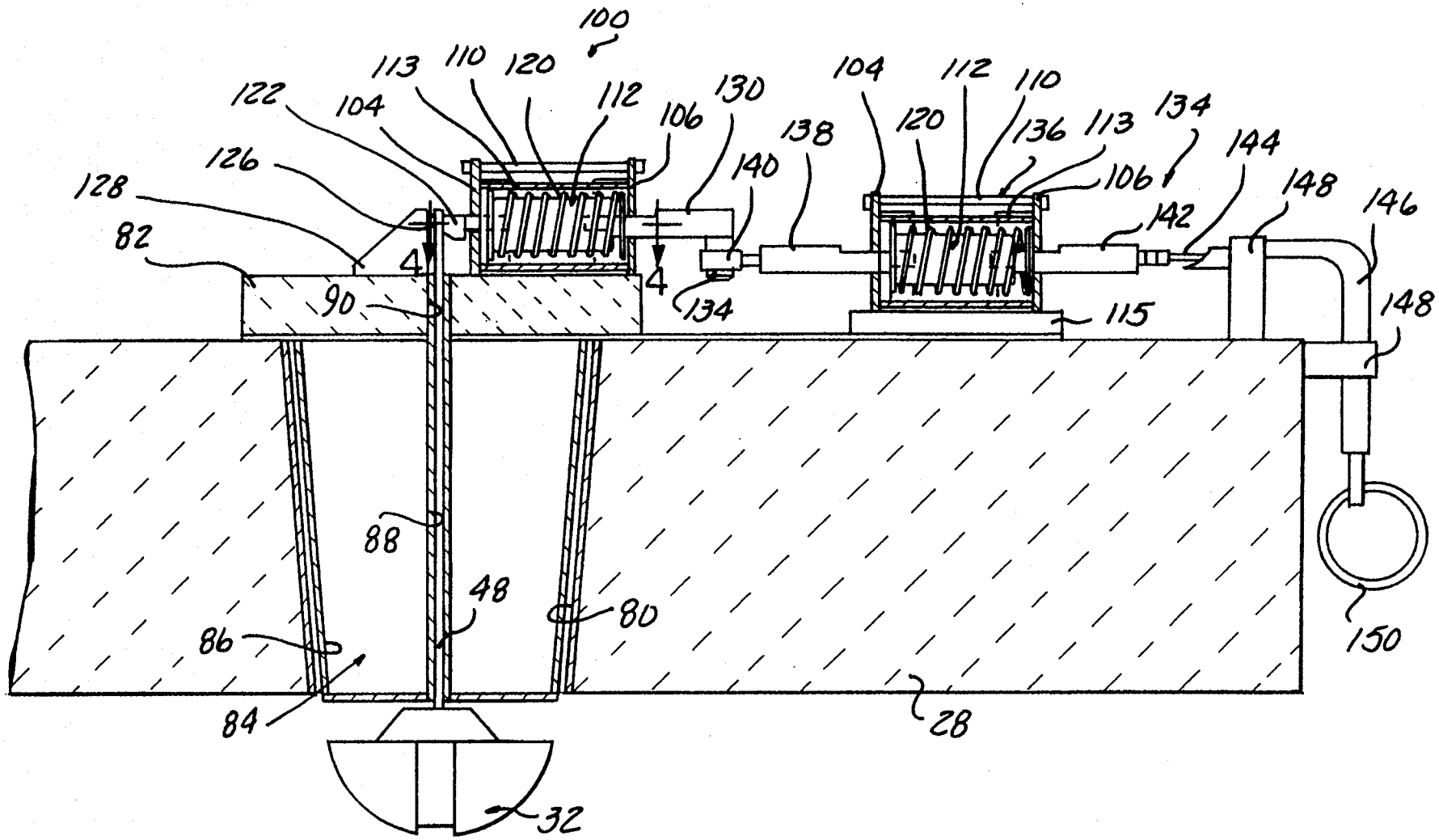
FIG. 3 is a partially cross sectioned, side elevational view of an improvement to the slag control shape release apparatus embodiment shown in FIG. 1.
Figure 4:
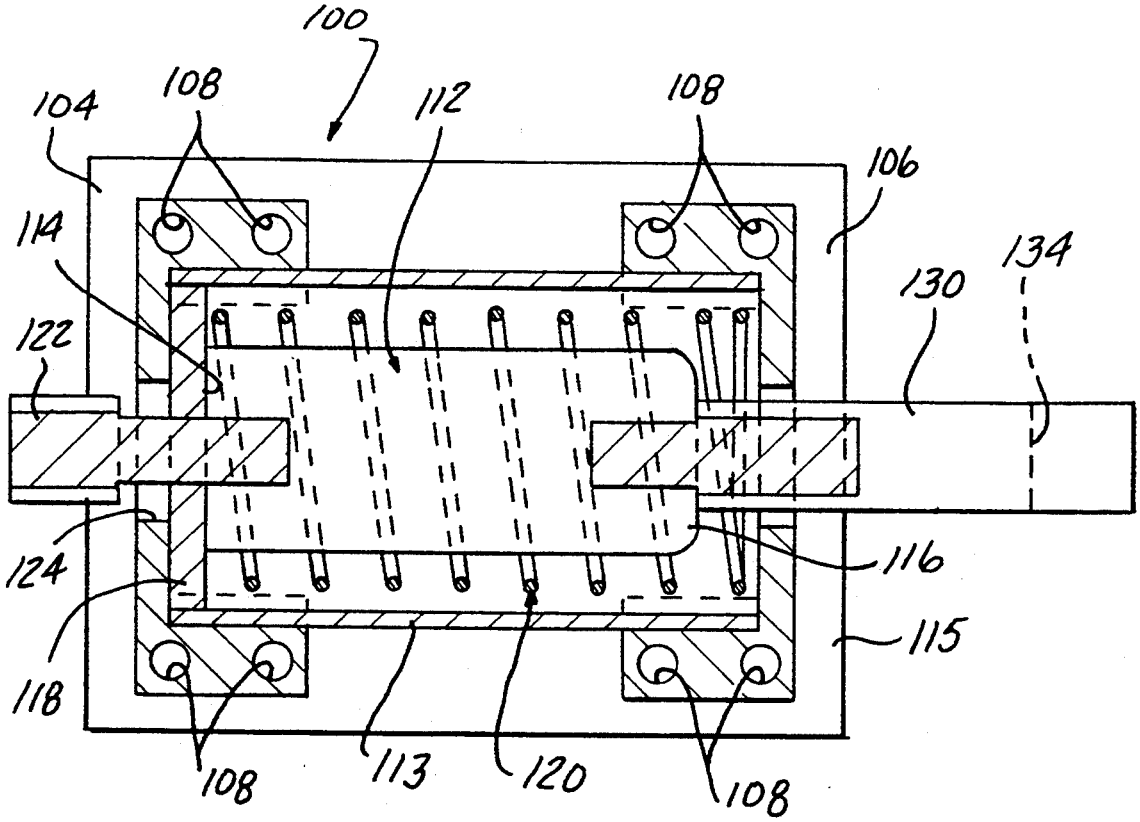
FIG. 4 is a cross sectional view of the mounting means generally taken along line 4—4 in FIG. 3.

Referring now to FIGS. 3 and 4, there is depicted an improvement to the embodiment described above and shown in FIG. 1. In this embodiment, the cover 28 includes a tapered bore 80 which extends from a large diameter end adjacent the top surface of the cover 28 to a smaller diameter end adjacent the inner surface of the cover 28.

A lid denoted generally by reference number 82 has a tapered plug 84 extending outwardly from one side thereof. The plug 84 may be formed of a solid body of refractory material or, preferably, an outer metal frame which surrounds a hollow interior 86. High temperature blanket insulation fills the hollow interior 86 of the plug 84. A bore 88 extends through the insulation in the interior 86 of the plug 84 for slidably receiving the hanger 48 attached to the slag control shape 32. A similar bore 90 is centrally formed in the lid 82 and is coaxially aligned with the bore 88 and the plug 84 for receiving one end of the hanger 48 therethrough. In use, the lid 82 and plug 84 are removably implacable in and close the bore 80 in the cover 28.

A mounting means denoted generally by reference number 100 is fixedly mounted on the lid 82 for releasably mounting the slag control shape 32 in the lid 82, with the slag control shape 32 positioned adjacent an inner surface of the cover 28 in a normal mounting position.

The mounting means 100 generally comprises a frame formed of opposed U-shaped corner brackets 104 and 106. Fasteners extend through bores 108 in each corner bracket 104 and 106 for securely attaching the corner brackets 104 and 106 to a base 115 fixedly mounted on the lid 82. As shown in FIG. 3, one tie rod 110 is fixedly secured to and extends between upper ends of the corner brackets 104 and 106 to retain the corner brackets 104 and 106 in a spaced relationship.

The inner surfaces of the side legs of each corner bracket 104 and 106 have arcuate-shaped recesses formed therein. A housing 113 having a generally circular cross section shape is mounted in the recesses in each of the corner brackets 104 and 106 and extends between the corner brackets 104 and 106. The housing 113 is hollow and, preferably, is formed of a suitable metallic material, preferably aluminum.

A slider member 112, generally having a solid, circular cross sectional, cylindrical shape includes first and second opposed ends 114 and 116, respectively. The slider 112 is slidably disposed within the interior of the housing 113. An enlarged base 118 is fixedly mounted at the first end 114 of the slider 112. A biasing means 120, preferably in the form of a coil spring, is disposed about the slider 112 and seats at one end on the base 118 and at another end to the corner bracket 106 to normally bias the slider 112 to a first position shown in FIGS. 3 and 4.

A pin 122 extends through a bore 124 in the corner bracket 104 and is fixedly attached to the first end 114 of the slider 112. Preferably, the pin 122 is threadingly mounted in a bore extending inward from the first end 114 of the slider 112. As shown in FIG. 3, the pin 122 has an angled end surface 126.

When the slider 112 is urged to the first position shown in FIG. 3, the pin 122 extends outwardly from the corner bracket 104 and engages a stop 128 which is fixedly mounted on the lid 82 and spaced from the corner bracket 104. In this position, the pin 122 extends through an aperture in the upper end of the hanger rod 48 to releasably mount the slag control shape in the cover 28 and the lid 82.

A catcher pin 130 extends through an aperture 132 in the corner bracket 106. The catcher pin 130 is fixedly attached at one end to the second end 116 of the slider 112, preferably by a threaded connection in a bore in the second end 116 of the slider 112. The catcher pin 130 extends outward from the corner bracket 106 and terminates in a depending leg 134.

As shown in FIG. 3, an activating means 134 is also mounted on the cover 28 for activating the mounting means 100 to release the slag control shape 32 from the pin 122. The activating means 134 includes a frame 136 which is identically constructed to the frame of the mounting means 100 in that it includes opposed corner brackets 104 and 106 which surround a slider 112 mounted in the housing 113. The corner brackets 104 and 106 are connected to a base 115 mounted on the cover 28. A biasing spring 120 biases the slider 112 to a first position shown in FIG. 3. A plunger 138 is fixedly mounted in and extends outwardly from one end of the slider 112. The plunger 138 terminates in an eye hook or apertured end 140 which releasibly receives the depending leg 134 of the catcher pin 130 on the mounting means 100. An arm 142 is fixedly mounted in and extends outwardly from the opposite end of the slider 112. An elongated release cable 144 which slidably extends through a cable shield 146 mounted on brackets 148 attached to the cover 28 is connected to the arm 142 and extends to a handle or ring 150 at an end remote from the cover 28.

In operation, the operator pulls the handle 150 which causes the arm 142 to urge the slider 112 in the actuating means 134 to a second position toward the corner bracket 106. This also urges the plunger 138, the catcher pin 130, the slider 112 in the mounting means 100, and the pin 122 to the right, in the orientation shown in FIG. 3, to disengage the pin 122 from the hanger 48 of the slag control shape 32 and to release the slag control shape from the cover 28 so that the slag control shape 32 drops into the interior of the molten metal vessel 10.

When it is necessary to mount a new slag control shape 32 in the mounting means 100, the lid 82 is removed from the cover 28 by disengaging the depending leg 134 of the catcher pin 130 from the eyehook 140 on the plunger 138. The catcher pin 130 is then retracted to the second position to open a space between the corner bracket 104 and the stop 128 to allow the passage of a hanger 48 of a new slag control shape 32 extending through the plug 84 and lid 82 into the space adjacent the stop 128. Release of the catcher pin 130 then enables the biasing spring 120 to urge the slider 112 and the pin 122 through the aperture at one end of the hanger 48 to releasably mount the hanger 48 of the new slag control shape 32 in the lid 82. The lid 82, the plug 84 and the newly mounted slag control shape 32 may then be reinstalled in the bore 80 in the cover 28.

Figure 6:
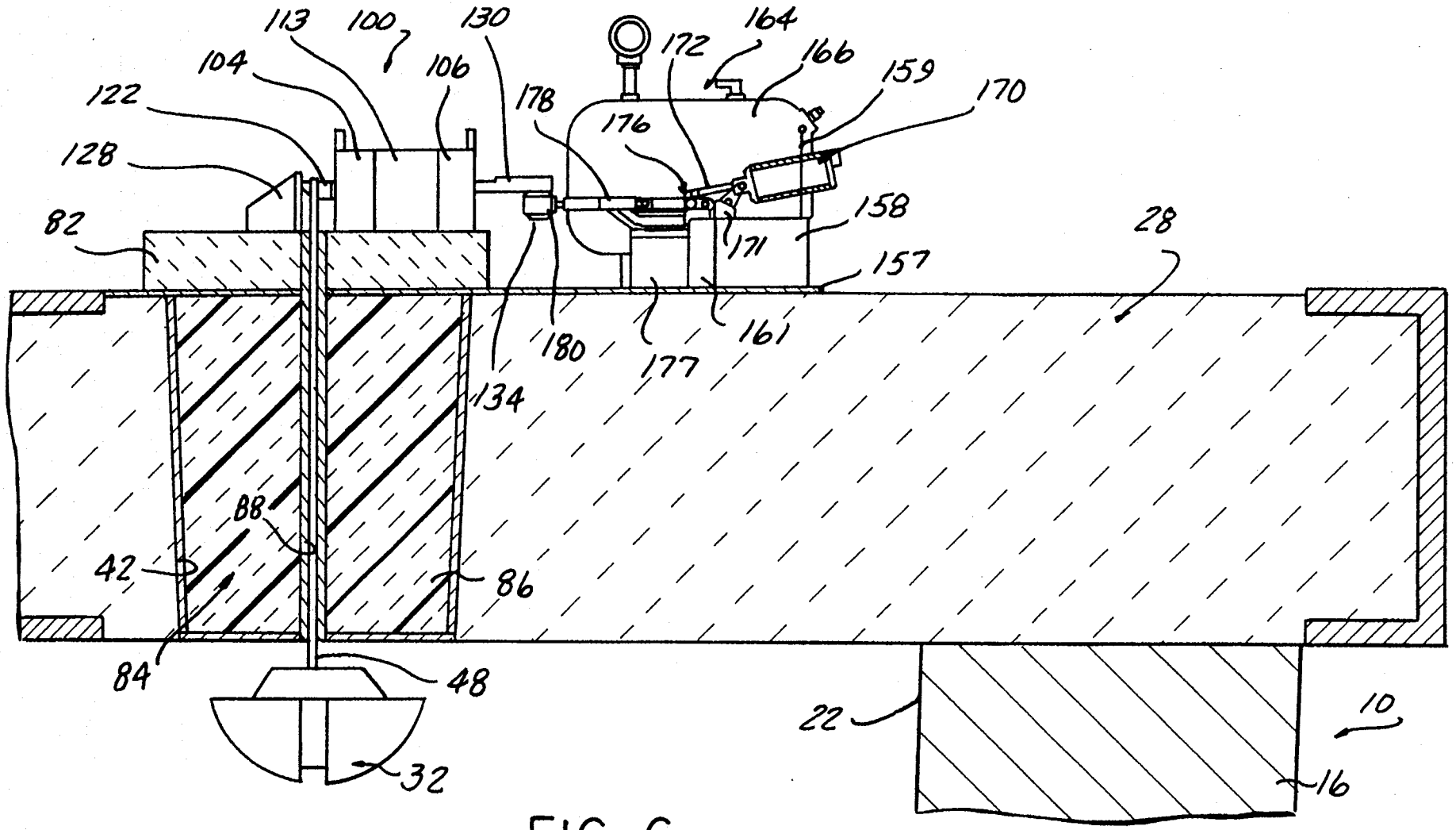
FIG. 6 is an enlarged, partially cross sectioned view, of a portion of the control apparatus shown in FIG. 5.
Figure 7:
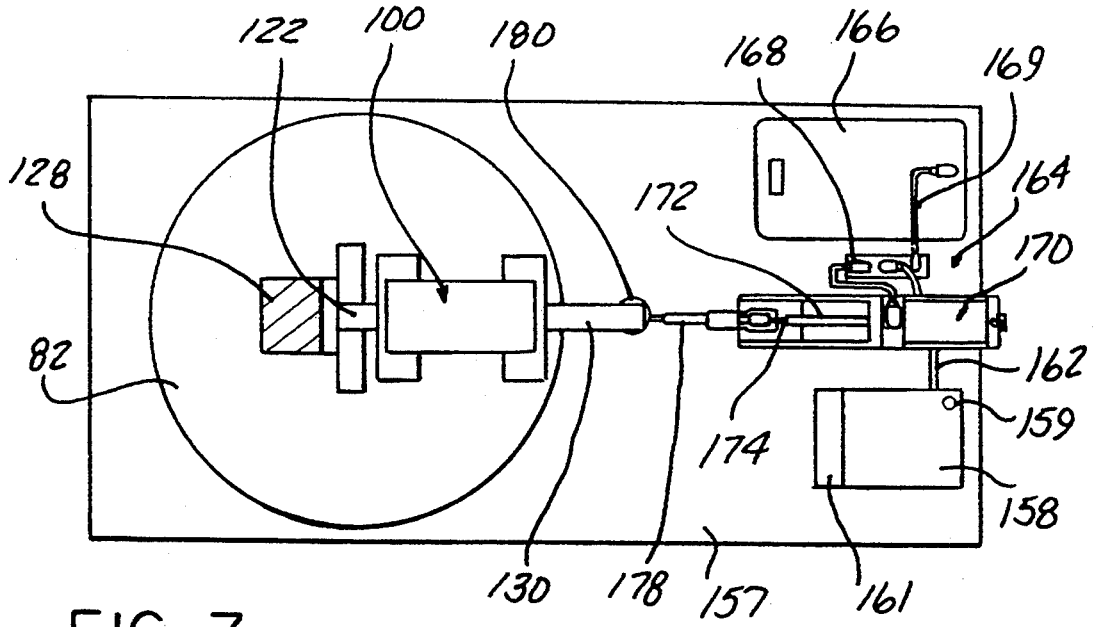
FIG. 7 is a plan view of the portion of the control apparatus shown in FIG. 6, depicted in its slag control shape holding position.

Referring now to FIGS. 5, 6 and 7, there is depicted a control apparatus which automatically releases a slag control shape 32 from a cover 28 of a molten metal vessel 10 at the proper time dependent upon a metal making condition or parameter. In this embodiment, a mounting means 100, identical to that described above and shown in FIGS. 3 and 4, is mounted on the lid 82. The plug 84 projects from the lid 82 and is releasably disposed within the bore 42 in the cover 28. The catcher pin 130 extends outward from the mounting means 100 and terminates in the depending leg 134.

The control apparatus includes a suitable controller 152 which may be in the form of a central processor unit or computer executing a stored program, or an electronic circuit. The controller 152 is responsive to a predetermined condition or parameter of the metal making operation for generating a signal at the proper time to release the slag control shape 32 from the mounting means 100. Preferably, the predetermined condition is the weight of molten metal 12 in the molten metal vessel 10.

The weight of the molten metal 12 in the vessel 10 can be obtained by means of a conventional ladle weight system 153 which includes a load cell to measure the weight of the vessel 10, the cover 28 and the molten metal 12 and slag 14 contained therein as exerted on the vessel cradle arms which support the vessel 10. The ladle weight system 153 provides an output signal on conductor 156 to the controller 152 which may be in one of two alternate forms. First, the output signal from the ladle weight system 153 may be a signal indicating that a predetermined weight has been detected. This predetermined weight, which can be adjustably set on the ladle weight system, is indicative of the total weight of the vessel 10, the cover 28 and the molten metal 12. Since the weight of the vessel 10 and cover 28 are known, the only variable weight is that due to the amount of molten metal 12 within the vessel 10. In this manner, when a predetermined weight is detected by the ladle weight system 153, as adjustably set by the operator, the ladle weight system 153 will provide the output signal on conductor 156 to the controller 152.

Alternately, the ladle weight system 153 may provide an output signal on conductor 156 to the controller 152 which is proportional to the total weight measured by the load cell in the ladle weight system 153. The controller 152 may be provided with a suitable software control program which subtracts out the known weight of the vessel 10 and the cover 28 from the total weight signal to obtain a weight measurement corresponding only to the weight of the molten metal 12 within the vessel 10. The molten metal weight may be measured against an adjustably selected threshold value corresponding, for example, to the weight of 10,000 or 25,000 pounds of molten metal within the vessel 10, to indicate to the controller 152 that a predetermined weight or amount of molten metal 12 remains in the vessel 10.

When the controller 152 receives the first weight signal, described above, from the ladle weight system 153 indicating a predetermined weight has been detected, or, when the controller 152 itself determines, as also described above, that a predetermined weight of molten metal 12 remains within the vessel 10, the controller 152 generates an output signal indicating that a predetermined weight of molten metal 12 is detected within the vessel 10. This predetermined weight of molten metal 12 is selected to represent a relatively small amount of molten metal 12 remaining within the vessel 10 at which it is desired to drop the slag control shape 32 into the interior of the vessel 10.

The output signal from the controller 152 is communicated or transmitted to a suitable signal receiver 158 mounted on the cover 28. In one embodiment, the output signal is a radio frequency signal transmitted from the controller 152 by a transmitter through an antenna 160. The radio frequency signal is received by the receiver 158 mounted on the cover 28. The receiver 158 is tuned to the same frequency of the signal transmitted from the controller 152 to prevent signal error between signals transmitted between other ladles and controllers.

Upon receiving the output signal at the proper frequency from the controller 152, the receiver 158 in turn generates a release signal on conductor 162 to an actuating means denoted generally by reference number 164. A power source 161, such as a battery, is electrically connected to the receiver 158 to provide electrical power to operate the receiver 158.

The actuating means 164 is mounted on a base 157 fixed on the cover 28. The actuating means 164 may comprise any suitable activating device which is capable of linearly moving the catcher pin 130, and the slider 112 and pin 122 connected thereto, a distance sufficient to release the hanger 48 of the slag control shape 32 from the pin 122. Thus, the activating means 164 may comprise a linear actuator, such as an electrical solenoid with a movable plunger.

Alternately, and by way of example only, the actuating means 164 includes a source 166 of pressurized fluid, such as pressurized air. The source 166 of pressurized fluid is preferably contained in a high pressure tank mounted on the base 157. A valve means 168 is also mounted on the base 157 and has one port disposed in fluid flow communication with the fluid source 166 by means of a conduit 169. The valve means 168 is preferably an electrically operated, spring return solenoid valve which receives the release signal on conductor 162 from the receiver 158. Upon receiving the release signal, the solenoid switches the flow path through the valve 168 to supply pressurized fluid from the tank 166 through the outlet port of the valve 168.

The outlet port of the valve 168 is connected by a conduit to a port on a fluid cylinder 170. The cylinder 170 is fixed to a mounting block 171 attached to the base 157 on the cover 28. The fluid cylinder 170 is conventional and, in a preferred embodiment, comprises an air clamp, such as an air clamp sold by De-Sta-Co, Troy, Mich., Model No. TC-803. In such a clamp, a piston, not shown, is mounted internally within the cylinder 170 and is moved in one direction by air pressure on one side of the piston or, when pressurized air is relieved, moves in the opposite direction. An elongated piston rod 172 is connected to the piston and has one end 174 extending outwardly from the cylinder 170. The end 174 is connected to a pivot linkage denoted generally by reference number 176. The pivot linkage 176 is supported by a mounting block 177 attached to the base 157. One end of the linkage 176 is connected to a plunger 178 having an eye bolt 180 mounted at an opposite end which slidably receives the depending leg 134 of the catcher pin 130 therethrough, as shown in FIG. 6. The pivot linkage 176 is arranged such that the plunger 178 extends or moves to the left to the position shown in FIGS. 6 and 7, when pressurized air through the valve 168 is relieved from the piston in the cylinder 170 thereby enabling the spring within the cylinder 170 to move the piston to one end of the cylinder 170. When pressurized air is applied through the valve 168 to the opposite side of the piston, the piston slides to the opposite end of the cylinder 170 thereby causing a retraction of the piston rod 170 to the right in the orientation shown in FIGS. 6 and 7. This retracts or draws the plunger 178 from the position shown in FIGS. 6 and 7 to a retracted position as described hereafter.

In operation, with the pin 122 in the extended, first position shown in FIG. 6 retaining a slag control shape 32 in the cover 28, the piston rod 172 of the piston 170 will be extended from the cylinder 170 thereby causing extension of the plunger 178 through the pivot linkage 176. When the receiver 158 receives the signal from the controller 152 and generates the release signal to the valve 168, the valve 168 will switch the flow of pressurized air to the cylinder 170 causing a retraction of the piston rod 172. Through the pivot linkage 176, this causes a retraction of the plunger 178 to the right as shown in FIG. 8 which retracts the pin 122 into the mounting means 100 and releases the slag control shape 32 from the cover 28 for descent into the interior of the molten metal vessel 10.

On a timed basis, the output signal from the controller 152 terminates thereby enabling the solenoid, by spring return action, to switch the valve 168 to a position enabling exhaust of the pressurized fluid from the cylinder 170 by the internal spring in the cylinder 170 which moves the piston in a direction causing extension of the piston rod 172 and a corresponding extension of the plunger 178.

With the lid 82 removed from the cover 28, the catcher pin 130 can be manually retracted to install a new slag control shape in the mounting means 100 as described above.

Figure 8:
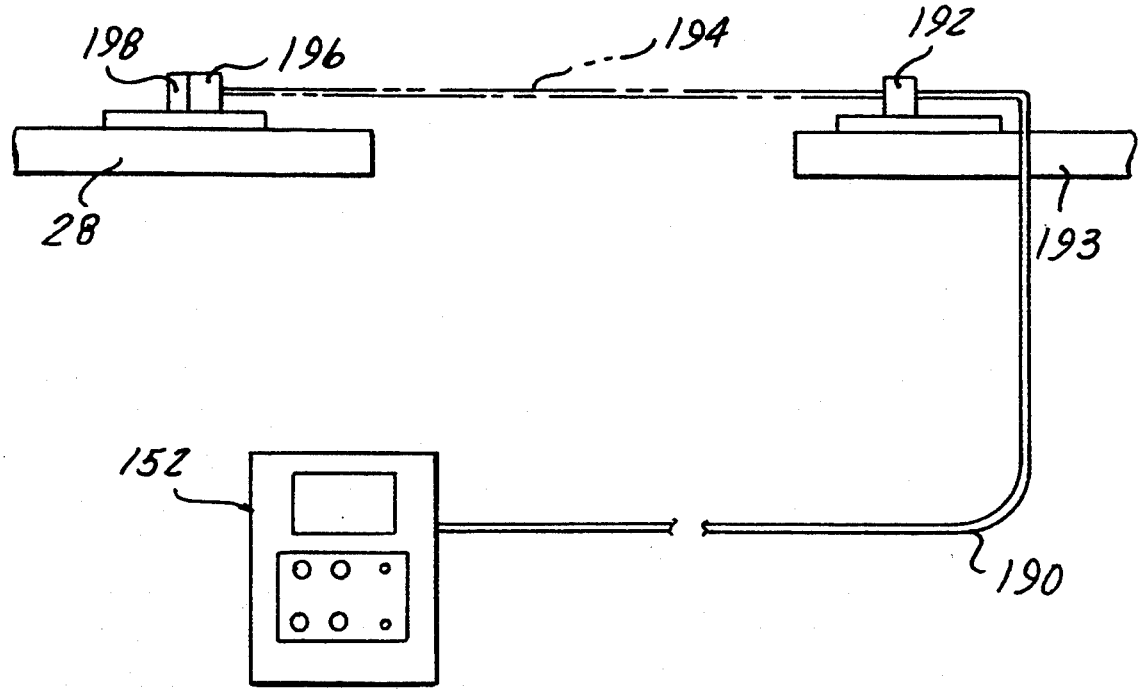
FIG. 8 is pictorial representation of another embodiment of the signal communication means of the control apparatus shown in FIG. 5.

An alternate signal communication means between the controller 152 and the actuating means 164 is shown in FIG. 8. In this embodiment, an electrical conductor 190 is connected between the controller 152 and a light emitter 192 mounted on a support 193 located adjacent the cover 28 of the vessel 10. The light emitter 192 may be any conventional light emitter element which is capable, when activated, of generating and projecting a light beam 194 over a predetermined distance or range. The light beam 194 may be any suitable light beam, such as infrared, a visible light beam, etc.

A suitable photodetector or photo sensor 196, provided with a battery power supply 198, is mounted on the cover 28 and spaced from the light emitter 192. The photodetector 196 detects the light beam 194 transmitted by the light emitter 192 and, in turn, generates an output or release signal, such as through a relay contact, to the valve 168 in the same manner as described above.

In a further embodiment, not shown, the electrical conductor 190 preferably mounted in a suitable insulating sheath may be connected directly between the controller 152 and the valve 68 for transmitting the signal from the controller 152 to the valve 168 to cause switching of the actuating means 164 and a release of the pin 122 from the hanger 48 of the slag control shape 32 as described above. In this embodiment, the conductor 190 can be provided with a quick disconnect preferably at the cover end to allow disconnection of the conductor 190 when the cover 28 is removed from the vessel 10.

In yet another embodiment, the predetermined condition detected by the controller 152 for activating the actuating means 164 to release the slag control shape 32 into the vessel 10 may be an adjustably settable time period which starts from the instant of opening of the flow control gate 200 connected to the outlet of the well block 24 in the vessel 10, as shown in FIG. 5. Such flow gates 200 are well known and, by way of example only, may comprise any suitable flow gate, such as flow gates sold by Flo-Con Systems, Inc., Champaign, Ill.; Nippon Rotary Gate, Co., Ltd., Japan or a similar flow gate sold by M. H. Detrick Co. of Chicago, Ill. Such flow gates are typically moved between open and closed positions by means of a suitable drive device, such as a motor or fluid cylinder. When moved to the open position by the drive means, the flow gate 200 allows the discharge of molten metal 12 from the vessel 10 through the flow gate and a shroud 206 surrounding and extending from the nozzle outlet of the flow gate 200 to a tundish in a continuous casting operation.

The activation signal which activates the drive means to move the flow gate 200 to an open position to start the discharge of molten metal 12 from the vessel 10, may be supplied as an input signal to the controller 152. The controller 152 then starts an adjustably settable time period which is selected based on the size of the vessel 10 and the known flow characteristics of molten metal 12 therefrom to provide an estimation of the amount of molten metal 12 remaining in the vessel 10 after a predetermined period of time from the start of metal discharge through the flow gate 200. At the completion of the predetermined time period, the controller 152 generates the output signal to the activating means 164, according to any of the signal communication means described above, to activate the activating means 164 to release the slag control shape 32 into the vessel 10.

Figure 9:
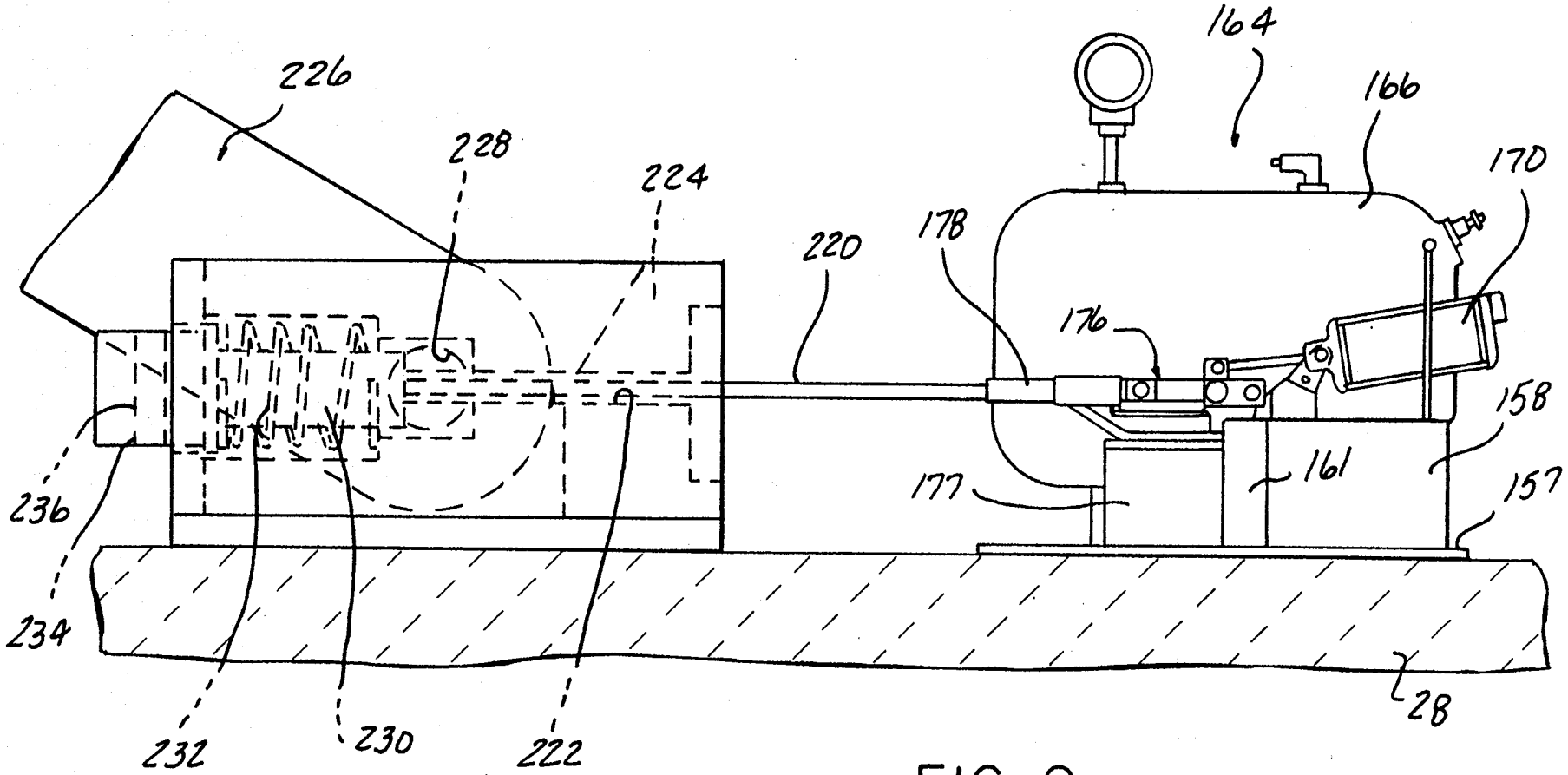
FIG. 9 is a partial, side elevational view of the use of the control apparatus of the present invention on a prior slag control shape release apparatus devised by the Applicants'.

Referring now to FIG. 9, there is depicted a modification to the second embodiment of a slag control shape release apparatus shown in FIGS. 8–10 of U.S. Pat. No. 5,303,902, the contents of which are incorporated herein by reference, and which utilizes the control apparatus of the present invention described above. As shown in FIG. 9, the activating means 164 including a radio frequency receiver 158 is mounted on the base 157 which is fixedly mounted on the cover 28. The plunger 178 is connected to an elongated rod 220 which slidably extends through a bore 222 formed in a yoke 224 which is also fixedly mounted on the cover 28. The yoke 224 pivotally receives two legs of an arm assembly 226 as described in greater detail in U.S. Pat. No. 5,303,902.

One end of the rod 220 is fixedly connected to a slider 230 slidably mounted in the yoke 224 and biased to a first position shown in FIG. 9 by means of a coil spring 232 disposed about the slider 230. A recess 234 which communicates with a narrow slot 236 is formed at one end of the slider 230, with the recess 234 and the slot 236 adapted to receive one notched end of a slidable pin, as shown in U.S. Pat. No. 5,303,902. The other end of the pin releasably supports the slag control shape 32 on the cover 28.

In this embodiment, activation of the actuating means 164 causes a retraction of the rod 220 from the first position shown in FIG. 9 which results in a sliding movement of the pin and a release of the slag control shape from the mounting means on the cover 28 for free fall or a controlled descent into the molten metal vessel 10, as described in detail in U.S. Pat. No. 5,303,902. When it is desired to load a new slag control shape in the mounting means, the arm assembly 226 is pivoted upward, as shown in FIG. 9, thereby disengaging the notched end of the pin from the recess 234 and the slot 236 in the slider 230. After a new slag control shape has been mounted in the mounting means and held in position by means of the pin, the arm assembly 226 is lowered to its normal position thereby bringing the recess 234 and slot 236 into engagement with the notched end of the pin to connect the slider 230 and the rod 220 to the pin for movement of the pin as described above.

In summary, there has been disclosed a unique control apparatus for use with molten metal vessels which enables a slag control shape or body to be automatically inserted into the molten metal vessel at the appropriate time without requiring the ladleman to climb a stairway to manually insert the slag control shape into the vessel or release the slag control shape from a mounting means on the cover. The apparatus is conveniently mounted on a cover on the open top end of the vessel so as to enable the easy positioning of the slag control shape in the cover prior to its insertion into the vessel. The control apparatus uniquely utilizes radio frequency communication between a controller mounted on the ground and a receiver mounted on the cover to automatically release the slag control shape from the mounting means at the proper time. The controller is responsive to the weight of molten metal in the molten metal vessel or to the total time of metal discharge to generate the slag control shape release signal at the appropriate time.

What is claimed is:

1. A slag control apparatus for inserting a shag control shape into a molten metal vessel having an open top closable by a cover, a discharge outlet, a flow gate attached to the discharge outlet for controlling the flow of molten metal through the discharge outlet, and a shroud extending from the flow control gate, the slag control apparatus comprising:

means, mounted on the cover, for releasably mounting a slag control shape on the cover;

means, mounted on the cover and connected to the mounting means, for moving the mounting means to a position releasing the slag control shape from the mounting means; and means, responsive to the occurrence of a condition, for automatically activating the moving means to release the slag control shape into the molten metal vessel.

2. The slag control apparatus of claim 1 wherein:

the condition is a weight of molten metal in the molten metal vessel.

3. The slag control apparatus of claim 2 further comprising:

means for detecting a weight of molten metal in the molten metal vessel, the detecting means generating an output signal upon detecting the predetermined weight of molten metal.

4. The slag control apparatus of claim 1 further comprising:

means for weighing the molten metal vessel, the cover and the molten metal contained therein;

means for determining when a weight of molten metal remains in the molten metal vessel, the determining means generating a signal indicative of the predetermined weight of molten metal remaining in the molten metal vessel.

5. The slag control apparatus of claim 1 wherein the activating means comprises:

a source of pressurized fluid;

a fluid operated cylinder having an extensible and retractable piston rod, the piston rod extending outwardly from the cylinder;

the piston rod fixedly connected to the mounting means for moving the mounting means between a first normal position retaining the slag control shape in the mounting means and a second slag control shape release position;

valve means for selectively supplying pressurized fluid from the fluid source to the cylinder to extend and retract the piston rod in response to a control signal; and control means, responsive to the occurrence of the condition, for generating the control signal.

6. The slag control apparatus of claim 5 wherein:

the valve means is an electrical solenoid operated valve means, responsive to the control signal, for controlling the flow of pressurized fluid to the cylinder to move the piston rod to a second position corresponding to the second slag control shape release position of the mounting means.

7. The slag control apparatus of claim 5 further comprising:

a movable plunger having first and second ends;

means for releasably connecting the first end of the plunger to the moving means; and pivot linkage means, connected between the end of the piston rod and the second end of the plunger, for transmitting movement of the piston rod to movement of the plunger.

8. The slag control apparatus of claim 5 wherein the control means further comprises:

means for communicating the control signal from the control means to the valve means.

9. The slag control apparatus of claim 8 wherein the communicating means comprises:

radio frequency transmitter means, responsive to the control signal, for transmitting a radio frequency signal upon the occurrence of the control signal; and radio frequency receiver means, connected to the valve means and responsive to the radio frequency signal from the transmitter means, for energizing the valve means switch the position of the piston rod to move the moving means to a position releasing the slag control shape from the mounting means.

10. The slag control apparatus of claim 8 wherein the communicating means comprises:

a light emitter, responsive to the control signal from the control means, for emitting a light beam;

a light detector, mounted on the cover in spaced relationship from the light emitter, the light detector generating an output signal to the valve upon receiving the light beam from the light emitter.

11. The slag control apparatus of claim 9 wherein the communicating means comprises:

an electrical conductor connected between the control means and the valve means.

12. The slag control apparatus of claim 5 wherein the moving means comprises:

a frame;

a pin slidably mounted in the frame and movable between first and second positions, the pin having a first end extending outwardly from one end of the frame when the pin is in the first position for releasably supporting a slag control shape thereon, a second end of the pin extending outwardly from an opposite end of the frame and connected to the activating means.

13. The slag control apparatus of claim 12 further comprising:

means for releasably connecting the piston rod to the second end of the pin.

14. The slag control apparatus of claim 13 wherein the releasible connecting means comprises:

a leg extending from one of the second end of the pin and the piston rod; and a mating aperture formed in the other of the second end of the pin and the piston rod for releasably connecting the pin and the piston rod.

15. The slag control apparatus of claim 1 further comprising:

a lid removably implacable in and closing a bore in the cover, a through bore extending through the lid for slidably receiving a slag control shape therethrough, the moving means being mounted on the lid.

16. The slag control apparatus of claim 1 further comprising:

means for detecting and generating a signal upon the occurrence of the condition;

means, responsive to the signal from the detecting means, for communicating a control signal to the activating means to activate the activating means to release the slag control shape from the mounting means.

17. The slag control apparatus of claim 16 wherein the communicating means comprises:

radio frequency transmitter means, responsive to the control signal, for transmitting a radio frequency signal upon the occurrence of the control signal; and radio frequency receiver means, connected to the valve means and responsive to the radio frequency signal from the transmitter means, for activating the activating means to move the moving means to a position releasing the slag control shape from the mounting means.

18. The slag control apparatus of claim 16 wherein the communicating means comprises:

a light emitter, responsive to the control signal from the control means, for emitting a light beam;

a light detector, mounted on the cover in spaced relationship from the light emitter, the light detector generating an output signal to the valve upon receiving the light beam from the light emitter.

19. The slag control apparatus of claim 16 wherein the condition is the total time of molten metal flow from the molten metal vessel, the detecting means generating a signal at the expiration of an amount of time of molten metal flow.

20. The slag control apparatus of claim 1 wherein the moving means comprises:

a frame;

a pin slidably mounted in the frame and movable between first and second positions, the pin having a first end extending outwardly from one end of the frame when the pin is in the first position for releasably supporting a slag control shape thereon, a second end of the pin extending outwardly from an opposite end of the frame and connected to the activating means.

21. The slag control apparatus of claim 20 further comprising:

a lid. removably implacable in and closing a bore in the cover, a through bore extending through the lid for slidably receiving a slag control shape therethrough, the moving means being mounted on the lid.

22. The slag control apparatus of claim 21 further comprising:

means for releasibly connecting the pin to the activating means to permit removal of the lid from the cover.

* * * * *